US007097536B2

(12) United States Patent
Golzarian

(10) Patent No.: US 7,097,536 B2
(45) Date of Patent: Aug. 29, 2006

(54) ELECTRICALLY ENHANCED SURFACE PLANARIZATION

(75) Inventor: Reza M. Golzarian, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/883,499

(22) Filed: Jun. 30, 2004

(65) Prior Publication Data

US 2006/0003670 A1 Jan. 5, 2006

(51) Int. Cl.
*B24B 51/00* (2006.01)

(52) U.S. Cl. ..... 451/5; 451/36; 451/54; 451/287

(58) Field of Classification Search ..... 451/5, 451/36, 37, 41, 54, 287, 288, 289; 204/224 M; 205/662

See application file for complete search history.

(56) References Cited

U.S. PATENT DOCUMENTS

| | | | | |
|---|---|---|---|---|
| 5,575,706 | A * | 11/1996 | Tsai et al. | 438/693 |
| 5,911,619 | A * | 6/1999 | Uzoh et al. | 451/5 |
| 6,010,964 | A * | 1/2000 | Glass | 438/692 |
| 6,368,190 | B1 * | 4/2002 | Easter et al. | 451/41 |
| 6,464,855 | B1 * | 10/2002 | Chadda et al. | 205/662 |
| 6,776,693 | B1 * | 8/2004 | Duboust et al. | 451/41 |
| 2004/0173461 | A1 * | 9/2004 | Tsai et al. | 204/640 |
| 2004/0214510 | A1 * | 10/2004 | So | 451/41 |
| 2004/0259479 | A1 * | 12/2004 | Sevilla | 451/41 |
| 2004/0266193 | A1 * | 12/2004 | Bogart et al. | 438/692 |
| 2004/0266327 | A1 * | 12/2004 | Chen et al. | 451/526 |
| 2005/0016868 | A1 * | 1/2005 | Basol et al. | 205/654 |
| 2005/0035000 | A1 * | 2/2005 | Lee et al. | 205/640 |

* cited by examiner

*Primary Examiner*—Jacob K. Ackun, Jr.
(74) *Attorney, Agent, or Firm*—Schwabe, Williamson & Wyatt, P.C.

(57) ABSTRACT

A substrate processing apparatus equipped to employ electrical potential to assist in planarization and/or conditioning is provided.

27 Claims, 5 Drawing Sheets

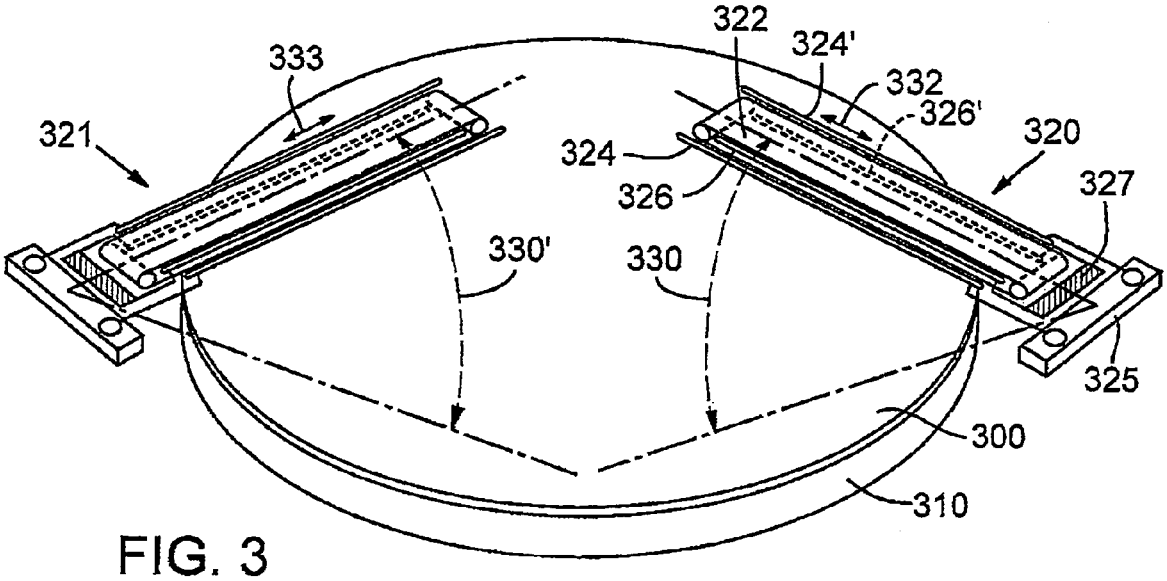
FIG. 3
FIG. 4
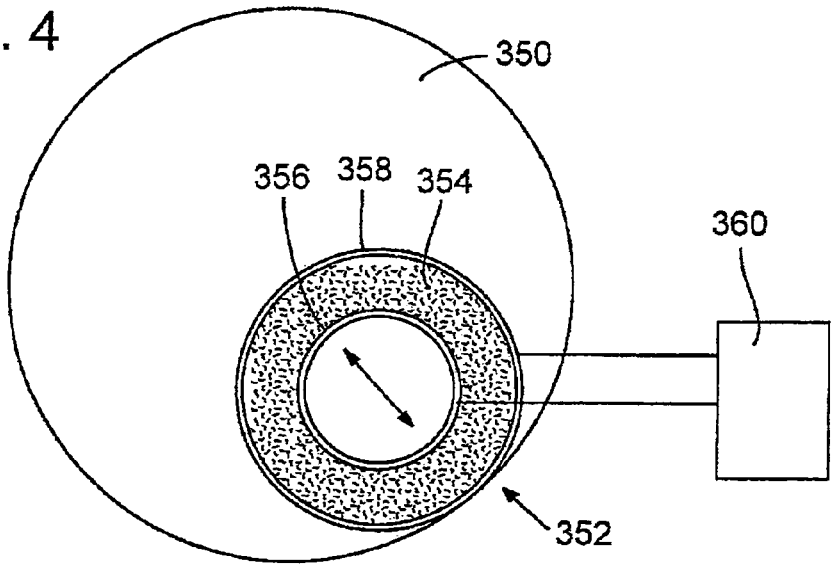

ELECTRICALLY ENHANCED SURFACE PLANARIZATION

FIELD OF THE INVENTION

Embodiments of the present invention relate to apparatus and methods for chemical mechanical planarization (CMP), and more particularly, to electrically enhanced CMP in the semiconductor device manufacturing process.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

FIG. 3 illustrates a perspective view of an electrically enhanced substrate processing apparatus in accordance with an embodiment of the present invention;

FIG. 4 illustrates a top view of an electrically enhanced substrate processing apparatus in accordance with an embodiment of the present invention;

DETAILED DESCRIPTION OF EMBODIMENTS OF THE INVENTION

Figure 1A:
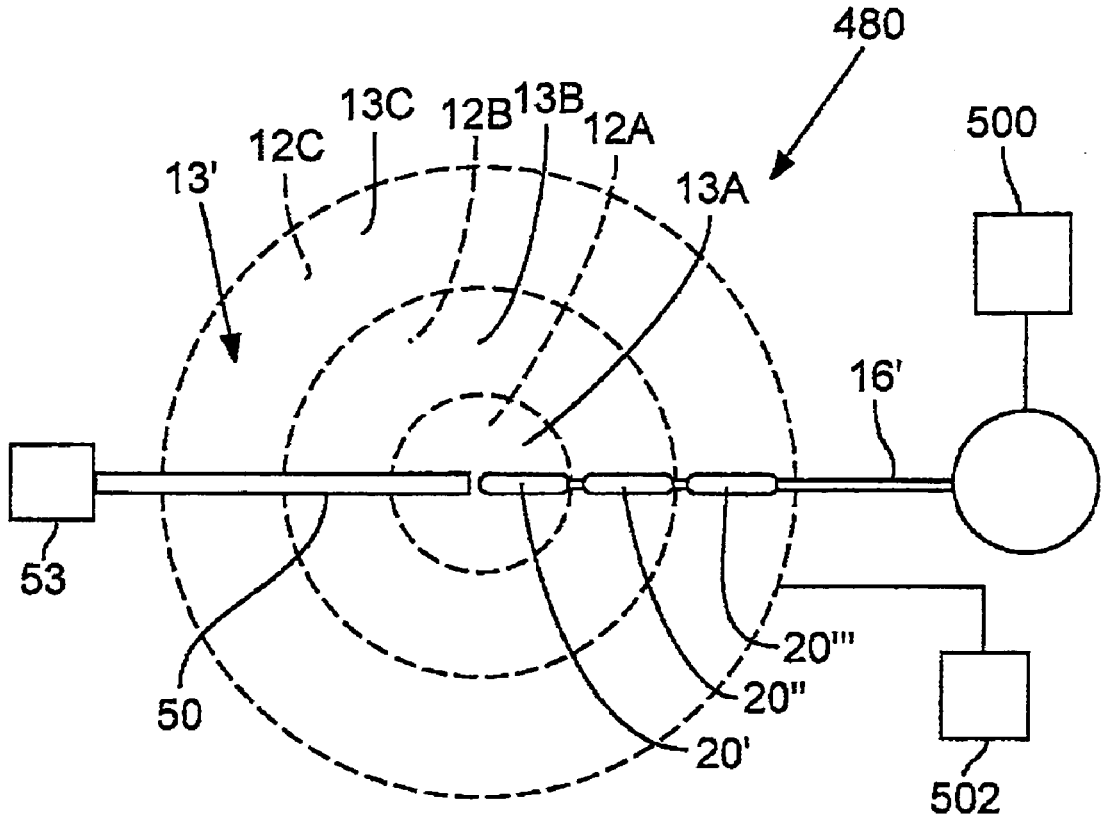
FIGS. 1A and 1B illustrate a top view and a side view respectively of an electrically enhanced substrate processing apparatus in accordance with an embodiment of the present invention.

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

In the following description, reference is made to processing pieces which may include a variety of processing elements, including, but not limited to, polishing pads, linear oscillating pads, conditioning pieces, conditioning pads, etc. It is understood in the art that polishing pads may be used to planarize substrates. It should be appreciated that substrates as utilized herein may be any suitable type of material such as semiconductor wafers, layers in semiconductor devices, etc. Where the electrically enhanced processing is performed in a conditioning process, for example, the substrate may include the polishing pad and the processing piece may include the conditioning pads, as it may be understood that conditioning pieces may be used to clean and/or condition the polishing pads surface, either after the polishing process/step where it may fill or clog with polishing components and wear, or prior to the polishing process/step.

Embodiments in accordance with the present invention include those that are directed to processing a substrate surface (e.g., planarizing, polishing, conditioning, etc.) in a CMP process using a complementary electrical potential to control the removal of material from the surface of the substrate and/or change the surface characteristics of the substrate surface form one state to another (e.g. change from hydrophobic to hydrophilic and visa versa). It is understood and appreciated that example methods and apparatuses illustrated herein that are described in terms of the planarization/polishing process may be substantially applicable to the conditioning process, as well as may be implemented prior to or after the planarization/polishing process step.

Embodiments in accordance with the present invention provide the ability to process semiconductor substrates more reliably, consistently, and uniformly during the planarization, conditioning and/or cleaning process. Using an electrical potential to complement the CMP may allow processing of the substrate using, for example, very low pressures, high rotational velocity, and manipulation of other parameters that may be particularly useful for planarization of ultra low-K materials. And, electrically enhanced substrate processing in accordance with embodiments of the present invention may help to prevent metal delamination during the planarization process, which may be caused by the weak adhesion between the low-K dielectric and the metal layer. Furthermore, using an electrically enhanced substrate planarization processing may enhance the ultra low pressure polishing processes used in ultra low-K planarization processes to prevent mechanical damage during the substrate processing step.

Embodiments in accordance with the present invention may be used with a variety of substrate processing tool configurations, including for example, tool configurations that use single or multiple polishing elements (or conditioning elements) to process the substrate surface. Where multiple elements are used, a corresponding number of substrate holder portions may be used such that different electrical potentials may be applied across the substrate to independently control the removal of material across different portions of the substrate surface. Some examples of different tool configurations may be seen in pending U.S. patent application Ser. No. 10/340,876 and applications related thereto.

In one embodiment in accordance with the present invention, the substrate may be a semiconductor wafer having a metalized layer that needs planarization, and the processing piece may include one or more processing elements that may be polishing pads adapted to planarize the metalized layer. Voltages may be applied to the processing elements and/or corresponding substrate holder portions to create an electrical potential across the substrate such that the electrolytic nature of the processing slurry may allow a current to flow across the surface of the substrate in the process side and electrically enhance and/or control the planarization by controlling material removal. In another embodiment in accordance with the present invention, the substrate may be the polishing pad and the processing element may be a conditioning pad adapted to condition the polishing pad. An electrical potential then may be used to electrically enhance the conditioning of the polishing pad.

Figure 1B:
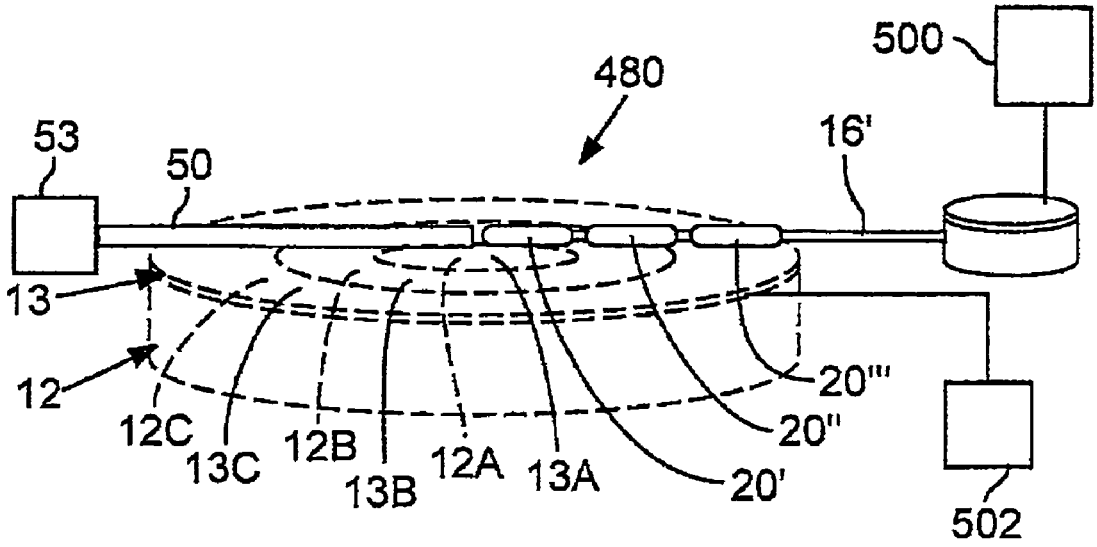

FIGS. 1A and 1B illustrate a top view and a side view respectively of an electrically enhanced substrate processing apparatus 480 in accordance with one embodiment of the present invention. Though any suitable number and/or types/configurations of processing pieces may be utilized to process a substrate, in one embodiment in accordance with the present invention, the processing pieces may include multiple processing elements, which as illustrated, may be cylindrical polishing pads 20. In the following descriptions, processing pads 20 are described as polishing/planarizing a substrate 13 (e.g., semiconductor substrate) but in other embodiments, it should be appreciated that the processing elements/pads 20 may be conditioning elements that can condition a polishing pad.

Polishing pads 20 may include first, second, and third polishing pads 20', 20", and 20'" and may be used to electrically enhance CMP. First, second, and third polishing pads 20', 20", and 20'" can be any material suitable for planarization/polishing. Suitable materials may include, but are not limited to polymers, such as poromeric polymers and/or polymeric polymers (e.g. polyurethane) with and without an embedded abrasive. Polishing pads 20 may be used in combination with an electrolytic etching slurry to planarize a process side 13' of a substrate 13. The polymer material used for polishing pads 20 may have sufficient surface and/or bulk porosity such that an ionic current can flow through the polymer material to the electrolytic slurry.

Polishing pads 20', 20", and 20'" may be independently coupled to electricity source 500. Electricity source 500 may selectively apply different voltages to the polishing pads 20', 20", and 20'" to generate different electrical potentials with respect to the substrate 13, which may be in electrical communication with a second complementary electricity source or an electricity ground 502.

Different electrical potentials may be applied across various regions 13A, 13B, and 13C of the substrate process side 13'. By applying an electrical potential across the regions 13A, 13B, and 13C, the removal of material on the process side 13' of the substrate 13 may be controlled to either enhance or suppress the removal of material from the different regions 13A, 13B, and 13C. Electrically enhanced planarization may be accomplished in cooperation with CMP by the polishing pads 20', 20", and 20'" respectively, and as a result of the differences in physical states of the materials of the process side 13' of the substrate 13.

In one embodiment, when any portion of a metal layer, such as copper, aluminum or other conductive material, or debris created during planarization is desired to be removed, an electrical potential may be applied to the substrate 13 such that the substrate is an anode and the polishing pad(s) may be cathode(s), to facilitate or assist in the removal. To make the substrate the anode and the polishing pad(s) the cathode(s), electricity sources 500 and 502 may be utilized to apply a voltage potential to the processing apparatus. In another embodiment in accordance with the present invention, the substrate may be made the cathode and the polishing pad or processing piece may be the anode and may affect substrate in such a way that it controls the removal of material from the process side in a different manner depending on the material properties.

Electrically enhanced planarization may be applied to the substrate 13 in any number of ways in accordance with the embodiments of the present invention. In one embodiment, rotatable substrate holder 12, which may include a polishing platen, may have an adjacent center, middle, and edge substrate holder portions 12A, 12B, and 12C substantially corresponding to adjacent center, middle, and edge substrate regions 13A, 13B, and 13C. The center, middle, and edge substrate holder portions 12A, 12B, and 12C may be electrically isolated from each other and may be independently coupled to an electricity or voltage source 502. Electricity source 502 may provide these substrate holder portions with any voltage type, such as a positive or negative voltage.

The corresponding adjacent first, second, and third polishing pads 20', 20", and 20'" may be provided with different voltages relative to the adjacent center, middle, and edge substrate holder portions 12A, 12B, and 12C such that there is a corresponding and distinct electrical potential across the center, middle, and edge substrate regions 13A, 13B, and 13C. These different electrical potentials may be varied to selectively control the removal of material in the respective substrate regions.

The center, middle, and edge substrate regions 13A, 13B, and 13C may electrically interact substantially only with corresponding first, second, and third polishing pads 20', 20", and 20'", respectively. In one example, when the center, middle, and edge substrate holder portions 12A, 12B, and 12C, which may or may not be physically decoupled from each other, are provided with a positive, negative, and positive potential, respectively, the polishing pads 20', 20", and 20'" may be provided with a negative, positive, and negative potential, respectively. The electrical potentials across the substrate regions 13A, 13B, and 13C may also be varied in charge or magnitude to selectively control the amount of material removal that is desired from the different regions of the substrate.

An electrolytic solution or slurry, with or without abrasives or abrading solutions, may be used to facilitate CMP and to electrically enhance the processing of the substrate 13. Delivery system 50 may dispense the electrolytic solution onto the substrate surface 13' and include a dispensing arm 53 with conduits capable of dispensing such electrolytic solution. In one embodiment, the electrolytic solution may provide an electrolytic film layer to electrically couple the center, middle, and edge substrate holder portions 12A, 12B, and 12C, and therefore the substrate regions 13A, 13B, and 13C with corresponding first, second, and third polishing pads 20', 20", and 20'", respectively. Electrical current i may flow between adjacent components through the electrolytic solution, bridging, for example, the first polishing pad 20' with the corresponding substrate surface region 13A and substrate holder portion 12A. Similar electrical arrangements may be made for the second and third polishing pads 20", and 20'", and middle and edge substrate holder portions.

The current i and slurry chemistry can provide the mechanism for electrically enhanced material removal of material from the substrate 13, and in particular, the metal components of the substrate surface. Suitable electrolytic polishing solution/slurry chemistries include, but are not limited to, acid(s) and/or base(s), pH stabilizing agents, chelating agents, oxidizers, metal ions (e.g. $CuSO_4$), inhibitors, surfactants, abrasives and polymers.

The current i may be controlled (either increased or decreased in accordance with the desired degree of material removal) by manipulating the voltages applied and/or increasing or decreasing the amount of electrolytes in the electrolytic solution. For example, as the desired degree of material removal is approached, the current i may be decreased or discontinued in one particular region of the substrate, such that the primary mechanism that contributes to the polishing are chemical and mechanical in nature, which may result in a slowing of the removal of material in that region. The chemistry of the electrolytic solution can be changed to be suitable for any type and/or stage of material removal depending on the operation desired.

Operating parameters, such as, electrolytic solution chemistry and the magnitude of current from the initial to final stages of the process can be determined empirically depending upon the composition of the substrate surface. Any suitable process metrology device or planarization endpoint detection mechanism known in the art may be used for stage determination.

The electrical potential and the current i may be generated by suitable voltage sources, such as, for example, an electricity source. It can be appreciated that the electricity sources 500 and 502 may be separate or a single electricity source and can be used to generate the desired voltages for the desired areas. It may also be appreciated that any suitable power supply may be utilized such as, for example, a battery, a power cord attached to an outlet, a transformer, etc. Further, it may be appreciated that the electricity sources may be external to the processing apparatus 480 or may be integrated within the apparatus, depending on factors such as the tool environment and location. Any suitable electrical signals may be utilized, such as a pulsed DC as a single anodic polarity, a pulsed DC with alternating polarity, a RF signal, a pulsed RF as a polarizing source and a triangular or sawtooth with alternating polarity. Other current i waveforms may be utilized such as, for example, variable magnitude single or alternating polarity. Signals corresponding to various waveforms of current versus time may be provided by the electricity source in order to optimize the relative removal of substrate material as a result of the electrically enhanced CMP process.

In accordance with one embodiment of the present invention, the generation from the electricity sources 500 and 502 may be controlled by a controller, such as a computing device. Any suitable type of computing device may also be the controller, such as a computer having a CPU, memory, buses, I/O ports, connected to the potential sources 500 and 502. In another embodiment, the controller may be connected to a metrology device, instrument or end-point detection device to determine when to stop the polishing operation. It should be appreciated that any suitable end-point detection methodology as known to those skilled in the art may be utilized. Software instructions and data may be stored within memory for causing the controller to generate suitable signals to the electricity sources 500 and 502 to control the electrical potentials and flow of current i.

In one embodiment in accordance with the present invention, the electricity sources may be electrically coupled to an electrolytic solution delivery system and the substrate holder. An electrolytic solution may act to close the circuit such that current i may flow between the delivery system and the substrate in order to electrically enhance and control planarization of the substrate. As with other embodiments in accordance with the present invention, different electrical potentials may be created across different portions of the substrate to facilitate selective removal of material across different portions of the substrate.

Figure 2A:
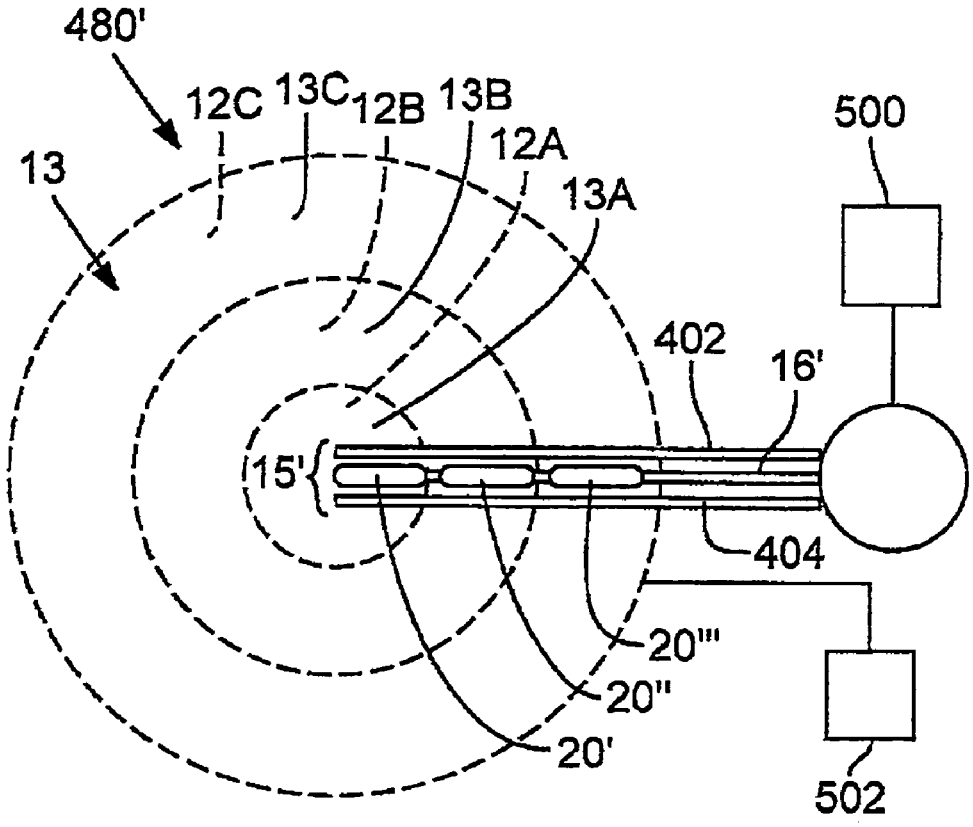
FIGS. 2A and 2B illustrate a top view and a side view respectively of an electrically enhanced substrate processing apparatus in accordance with an embodiment of the present invention.
Figure 2B:
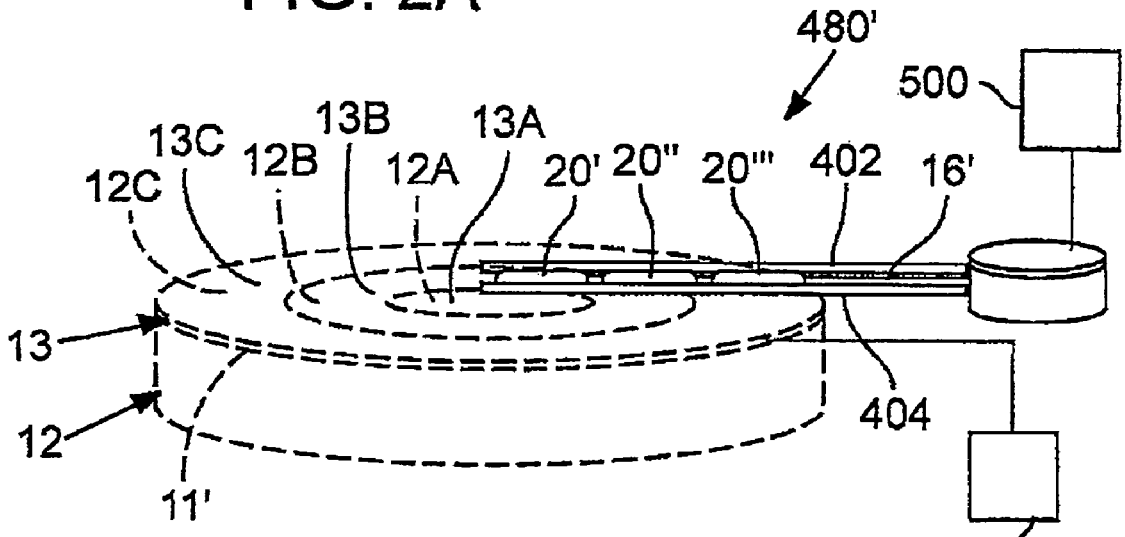

FIGS. 2A and 2B illustrate a top view and a side view respectively of an electrically enhanced substrate processing apparatus 480' in accordance with an embodiment of the present invention. In one embodiment, apparatus 480' may include a tool configuration that includes a rotatable substrate holder or polishing platen 12, a substrate 13 and electricity sources 500 and 502. Apparatus 480' may include a processing piece that has processing elements that may include first, second, and third polishing pads 20', 20", and 20'" operationally coupled to a control arm 16'. In other embodiments in accordance with the present invention, the processing piece may include processing elements that are other shapes, types, or configurations, including, but not limited to, a single cylindrical pad, single or multiple horizontally planar pads, or linearly oscillating pads.

In one embodiment, a conductive first element 402 may extend substantially adjacent to a first side of the control arm 16'. A conductive second element 404 may extend substantially adjacent to a second side of the control arm 16'. Conductive first and second elements 402 and 404 may generate an electrical potential across the polishing pads 20', 20", 20'", and create an electrical field in processing region 15'. This electrical field may electrically affect the substrate surface to electrically enhance the planarization of the process side 13 by increasing or decreasing the removal of material. The removal of material can be varied depending on the strength of the electrical field generated.

In one embodiment in accordance with the present invention, the conductive first and second elements 402 and 404 may be configured to have a positive and a negative charge respectively or vice versa, such that an electrical field may be generated between the conductive first and second elements 402 and 404. Electricity source 500 may be utilized to create an electrical potential across the conductive first and second elements 402 and 404 and create the electrical field across processing region 15'. By generating an electrical field between the first element 402 and the second element 404, polishing/planarizing may be controlled and managed such that the rate of polishing/planarization may be selectively modified based on the electrical input and resulting electrical potential generated.

In another embodiment in accordance with the present invention, the first and second conductive elements may be electrically segmented such that different electrical potentials may be created across different portions of the process pads. This may enable the different electrical potentials and fields to affect different regions of the substrate to allow selective control of material removal.

FIG. 3 illustrates a perspective view of an electrically enhanced substrate processing apparatus in accordance with an embodiment of the present invention. In one embodiment, a substrate 300 may be positioned for processing by processing piece 320 and 321. Processing piece 320 may include one or more processing elements 322, which in one embodiment may include one or more linearly moving and/or oscillating elements. It can be appreciated, however, that processing element 322 may be any one of a variety of configurations, including but not limited to cylindrical processing pads and the like.

In one embodiment, a conductive first element 324 may be positioned substantially adjacent to a first side of the processing element 322. A second conductive element 324' may be positioned substantially adjacent to an opposite second side of processing element 322. Both first and second conductive elements 324 and 324' may be coupled to an electricity source 325, similar to those previously described with regard to other embodiments in accordance with the present invention. A voltage, current, or other signal may be applied to each of the first and second conductive elements 324, 324' to generate an electrical potential across polishing pad 322 to electrically enhance planarization of substrate 300.

In one embodiment in accordance with the present invention, processing piece 320 and 321 may be configured to pivotally sweep across the surface of substrate 300 in a complementary fashion relative to each other as shown by arrows 330 and 330'. In another embodiment in accordance with the present invention processing pieces 320 and 320' oscillate as shown by arrows 332 and 333. Likewise, in another embodiment, substrate holder 310 and substrate 300 may also oscillate, revolve, and/or move as desired to facilitate processing of the substrate 300.

Embodiments in accordance with the present invention may also include inner conductive elements 326 and 326'. Inner conductive elements 326, 326' may be coupled to an electricity source 327 and adapted to create an electrical potential across the inner portion of the processing element 322 and to effect the process side of the substrate 300 to electrically enhance removal of material therefrom. Embodiments in accordance with the present invention may also include electrically isolated regions within the substrate holder to selectively control electrical potentials created across the different regions of the substrate in order to control removal of material from those regions, depending on the magnitude and positioning of the electrical potentials generated.

In one embodiment in accordance with the present invention, multiple linearly moving and/or oscillating elements may be grouped and extend radially inward, as opposed to a single linearly moving and/or oscillating element. Multiple processing elements may allow for application of a different electrical potential across different portions of the substrate. Multiple processing elements may also be moved and/or oscillated at different velocities to variably and independently control the processing of different regions of the substrate.

FIG. 4 illustrates a top view of an electrically enhanced substrate processing apparatus in accordance with an embodiment of the present invention. In one embodiment substrate 350 may be processed (e.g., planarized, polished, conditioned, etc.) by processing piece 352. Processing piece 352 may include a processing element 354 adapted to mechanically and chemically interact with substrate 350. Processing piece 352 may also include a conductive first element 356 and a conductive second element 358. In one embodiment, first element 356 may be substantially circumferentially adjacent to an inner side of processing element 354, and second element 358 may be substantially circumferentially adjacent to an outer side of processing element 354.

First and second elements 356, 358 may be electrically coupled to an electricity source 360 and adapted to create an electrical potential across processing element 354 and regions of substrate 350 as desired. Processing piece 352 may be adapted to rotate, oscillate, and/or move as desired in order to facilitate processing of substrate 350.

It can be appreciated that more than two conductive elements may be disposed in the process pad. For example, in one embodiment, multiple concentric rings may be positioned within the process pad to allow varying electrical potentials across certain portions of the processing element. In another embodiment, conductive elements may be disposed radially about the processing element 350, thus creating multiple different regions of the processing element. The conductive elements may be coupled to one or more electricity sources to create electrical potentials across different regions of the processing element 354 to controllably effect the process side of the substrate 350 and electrically enhance processing thereof.

Figure 5:
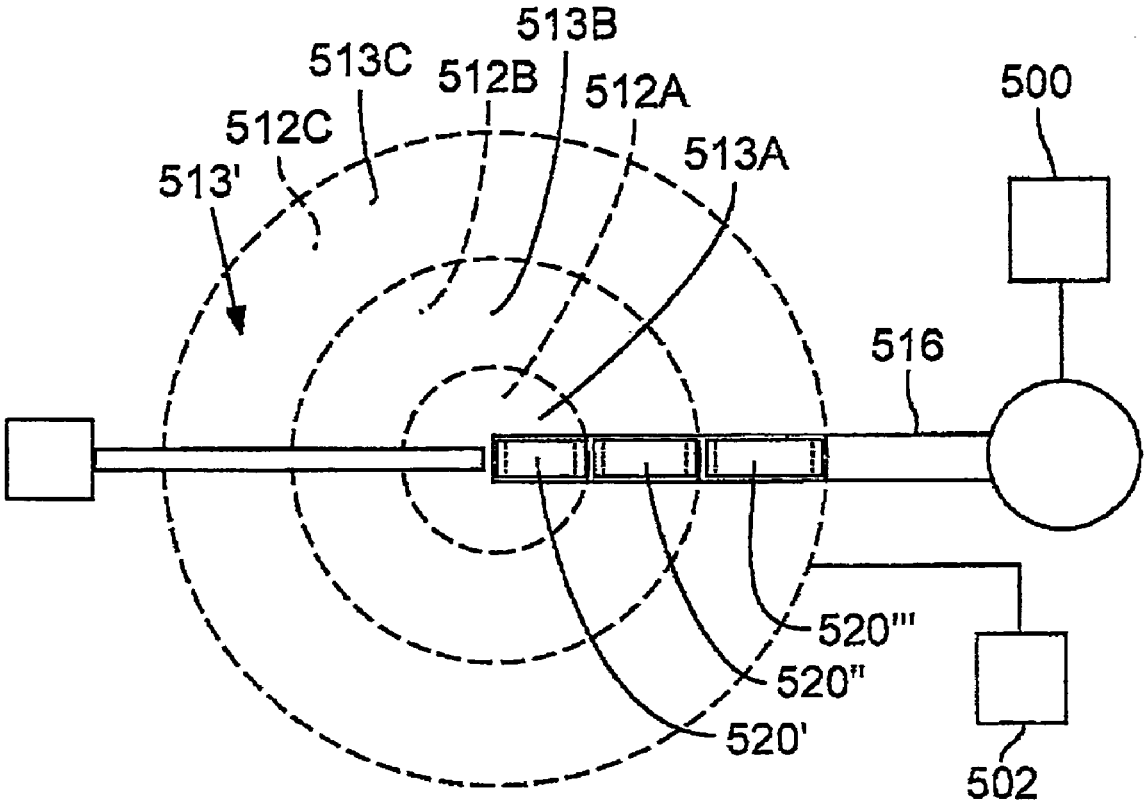
FIG. 5 illustrates a top view of an electrically enhanced substrate processing apparatus in accordance with an embodiment of the present invention.

FIG. 5 illustrates an example of a tool configuration similar to that of FIG.1, but where the processing elements 520', 520" and 520'" may be independent linear moving and/or oscillation elements. Linear moving and/or oscillating elements may be independently controllable as to speed of oscillation and/or movement by control arm 516. Substrate 513' may be processed by electrically enhanced planarization or conditioning. In one embodiment, adjacent center, middle, and edge substrate holder portions 512A, 512B, and 512C may substantially correspond to adjacent center, middle, and edge substrate regions 513A, 513B, and 513C. The center, middle, and edge substrate holder portions 512A, 512B, and 512C may be electrically isolated from each other and may be independently coupled to an electricity or voltage source 502.

First, second, and third processing elements 520', 520", and 520'" may be independently and variably coupled to voltage source 500, such that each processing may be provided with different voltages relative to each other. Accordingly, distinct electrical potentials may be applied across the center, middle, and edge substrate regions 513A, 513B, and 513C. These different electrical potentials may be varied to selectively control the removal of material in the respective substrate regions.

Figure 6:
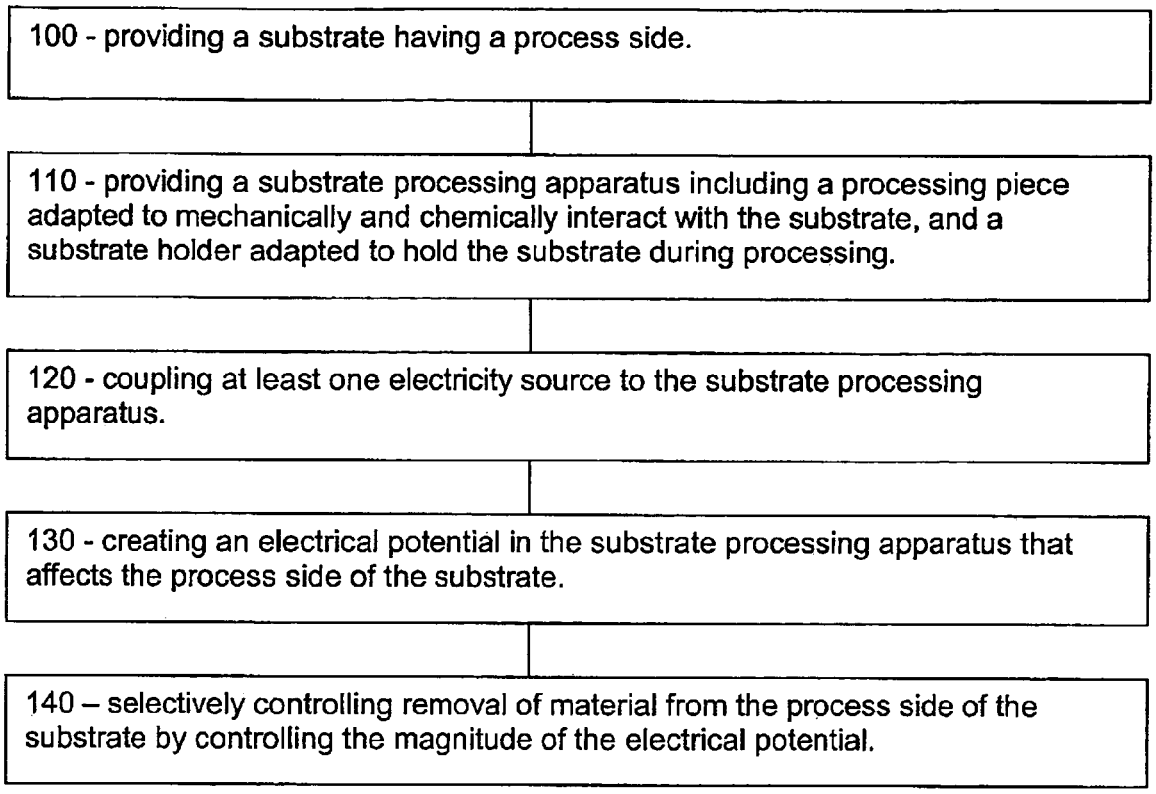
FIG. 6 illustrates a method of processing a substrate in accordance with an embodiment of the present invention.

FIG. 6 illustrates a method of processing a substrate in accordance with an embodiment of the present invention. A substrate, such as a semiconductor wafer, is provided that has a processing side on which material is to be removed (100). A substrate processing apparatus may be provided in accordance with embodiments of the present invention (110). The substrate processing apparatus may include a processing piece adapted to mechanically and chemically interact with the substrate, and a substrate holder adapted to hold the substrate during the processing. At least one electricity source, such as a voltage source, may be coupled to the substrate processing apparatus in accordance with embodiments of the present invention (120). An electrical potential may be created in the processing apparatus that may affect the process side of the substrate (130). Material on the process side of the substrate may then be controllably removed by changing the electrical potential applied to the substrate in conjunction with chemical and mechanical interactions (140).

Though the illustrated embodiments pertained to polishing pads planarizing substrates using electrically enhanced CMP, other embodiments in accordance with the present invention may be utilized in conditioning and/or cleaning processes. Also, though certain substrate processing tool configurations were illustrated, embodiments in accordance with the present invention can be used with a variety of other tool configurations and processes. Other tool configurations may include, but are not limited to, single processing elements, multiple processing elements, processing elements having simple and complex geometries, substrate holders having one or more electrically isolated regions, and/or multiple substrate holders.

Embodiments in accordance with the present invention may provide the ability to process larger semiconductor substrate and polishing pads more reliably, consistently, and uniformly during the planarization/conditioning process. The complementary application of an electrical potential or an electrical field to the CMP process may allow planarizing/polishing using very low pressures and very high rotational velocity, which may be particularly useful for planarization of ultra low-K materials. Similarly, the electrically enhanced processing also may help prevent metal delamination during the planarization process, which is caused by the weak adhesion between the low-K dielectric and the metal layer.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

The invention claimed is:

1. A substrate processing apparatus, comprising:

a substrate holder configured to hold a substrate, the substrate holder coupled to a first selected one of an electricity source and an electricity ground to contribute to effecting at least one electrical potential across at least a region of a process side of the substrate;

a processing piece adapted to facilitate mechanical and chemical interaction with the process side of the substrate, the processing piece being further coupled to a second selected one of an electricity source and an electricity ground, and configured to contribute to the effecting of the at least one electrical potential across at least a region of the process side of the substrate;

wherein the processing piece includes two or more processing elements, the two or more processing elements are independently and variably coupled to the second selected one of an electricity source and an electricity ground to provide different voltages to the two or more processing elements; and wherein the substrate holder has two or more substrate holder portions electrically isolated from each other, each of the two or more substrate holder portions positioned along the substrate hoolder to correspond to a different one of the two or more processing elements, the two or more substrate holder portions are independently and variably coupled to the first selected one of an electricity source and an electricity ground to provide different voltages to the two or more substrate holder portions, and when the two or more processing elements are in electrical communication with the two or more substrate holder portions to provide distinct electrical potentials therebetween each pair of corresponding processing elements and substrate holder portions.

2. The substrate processing apparatus of claim 1, wherein the first selected one of an electricity source and an electricity ground is a first source, and the second selected one of an electricity source and an electricity ground is a second source separate and distinct from the first source.

3. The substrate processing apparatus of claim 1, wherein the two or more processing elements are coupled to a control arm, the control arm configured to selectively apply the two or more processing elements to the process side of the substrate.

4. The substrate processing apparatus of claim 1, wherein a first processing element and a corresponding first substrate holder portion are complementarily adapted to effectuate a first electrical potential across a first portion of the substrate situated between the first processing element and the corresponding first substrate holder portion, and a second processing element and a corresponding second substrate holder portion are complementarily adapted to effectuate a second electrical potential across a second portion of the substrate situated between the second processing element and the corresponding second substrate holder portion, the first electrical potential being selectively controllable independent from the second electrical potential.

5. The substrate processing apparatus of claim 1, wherein the substrate is a semiconductor material having at least one metalized layer on the process side, and the processing piece includes at least one polishing element configured to planarize the at least one metalized layer.

6. The substrate processing apparatus of claim 1, wherein the substrate is a polishing pad and the processing piece includes at least one conditioning pad adapted to condition the polishing pad.

7. The substrate processing apparatus of claim 1, further comprising:

a metrology device configured to monitor processing of the process side of the substrate; and a control unit in communication with the metrology device and coupled to the first selected one of an electricity source and an electricity ground and the second selected one of an electricity source and an electricity ground, the control unit being adapted to selectively control the first and second selected one of an electricity source and an electricity ground to effectuate the at least one electrical potential.

8. A substrate processing apparatus, comprising:

a substrate holder configured to hold a substrate;

a processing piece including at least one processing element adapted for mechanical and chemical interaction with a process side of the substrate, the processing piece being further adapted to couple to at least one electricity source and configured to effect at least one electrical potential across at least one region of the process side of the substrate; and wherein the processing piece includes:

a conductive first element substantially adjacent to a first side of the at least one processing element; and a conductive second element substantially adjacent to a second side of the at least one processing element, the conductive first and second elements adapted to couple to the at least one electricity source and configured to create a first electrical potential across the at least one processing element.

9. The substrate processing apparatus of claim 8, wherein the processing piece includes two or more processing elements, and wherein the first and second elements are each segmented in electrically isolated segments that correspond to a different one of the two or more processing elements and adapted to generate distinct electrical potentials across each of the two or more processing elements.

10. The substrate processing apparatus of claim 8, wherein the processing piece comprises:

a conductive first inner element disposed within the processing element; and a conductive second inner element disposed within the processing element in a corresponding relationship with the first inner element, the first and second inner elements being adapted to couple to the at least one electricity source and configured to create a second electrical potential across the at least one processing element.

11. The substrate processing system of claim 8 wherein the substrate is a semiconductor material having at least one metalized layer on the process side, and the at least one processing element includes at least one polishing pad configured to planarize the at least one metalized layer.

12. The substrate processing apparatus of claim 8, wherein the substrate is a polishing pad and the at least one processing element includes at least one conditioning pad adapted to condition the polishing pad.

13. The substrate processing apparatus of claim 8, further comprising:

a metrology device configured to monitor processing of the process side of the substrate; and a control unit in communication with the metrology device and coupled to the at least one electricity source, the control unit adapted to selectively control the at least one electrical potential by regulating the at least one electricity source.

14. A substrate processing system, comprising:

a substrate processing apparatus including a substrate holder to hold a substrate, and a processing piece adapted to contribute to a mechanical and chemical interaction with a process side of the substrate;

at least one electricity source coupled to the processing apparatus adapted to selectively cause an electrical potential to be effectuated across the processing side of the substrate;

wherein the substrate holder is coupled to a first selected one of an electricity source and an electricity ground to contribute to effecting at least one electrical potential across at least a region of the processing side of the substrate;

wherein the processing piece is coupled to a second selected one of an electricity source and an electricity ground, and configured to contribute to the effecting of at least one electrical potential across a region of the processing side of the substrate;

wherein the processing piece includes two or more processing elements, the two or more processing elements are independently and variably coupled to the second selected one of an electricity source and an electricity ground to provide different voltages to the two or more processing elements; and wherein the substrate holder has two or more substrate holder portions electrically isolated from each other, each of the two or more substrate holder portions positioned along the substrate hoolder to correspond to a different one of the two or more processing elements, the two or more substrate holder portions are independently and variably coupled to the first selected one of an electricity source and an electricity ground to provide different voltages to the two or more substrate holder portions, and when the two or more processing elements are in electrical communication with the two or more substrate holder portions to provide distinct electrical potentials therebetween each pair of corresponding processing elements and substrate holder portions.

15. The substrate processing system of claim 14, wherein the first selected one of an electricity source and an electricity ground is a first source, and the second selected one of an electricity source and an electricity ground is a second source, separate and distinct from the first electricity source.

16. The substrate processing system of claim 14, wherein the two or more processing elements are coupled to a control arm, the control arm configured to selectively apply the two or more processing elements to the process side of the substrate.

17. The substrate processing system of claim 14, wherein a first processing element and a corresponding first substrate holder portion adapted to effectuate a first electrical potential across a first portion of the substrate situated between the first processing element and the corresponding first substrate holder portion and a second processing element and a corresponding second substrate holder portion adapted to effectuate a second electrical potential across a second portion of the substrate situated between the second processing element and the corresponding second substrate holder portion, the first electrical potential being selectively controllable independent from the second electrical potential.

18. The substrate processing system of claim 14, wherein the substrate is a semiconductor material having at least one metalized layer on the process side, and the processing piece includes at least one polishing element configured to planarize the at least one metalized layer.

19. The substrate processing system of claim 14, wherein the substrate is a polishing pad and the processing piece includes at least one conditioning pad adapted to condition the polishing pad.

20. The substrate processing system of claim 14, wherein a conductive first element is adjacent to a first side of the two or more processing elements, and a conductive second element is adjacent to a second side of the two or more processing elements, the conductive first and second elements being adapted to couple to the at least one electricity source and configured to create a first electrical potential across a portion of the at least one processing element.

21. The substrate processing system of claim 14, wherein the processing piece includes a conductive first inner element disposed within a processing element, and a conductive second inner element disposed within the processing element in a corresponding relationship with the first inner element, the first and second inner elements being adapted to couple to the at least one electricity source and configured to create a second electrical potential across the at least one processing element.

22. The substrate processing system of claim 14, further comprising:

a metrology device configured to monitor the processing of the process side of the substrate; and a control unit in communication with the metrology device and coupled to the at least one electricity source, the control unit adapted to modify the electrical potential of the processing apparatus by selectively regulating the at least one electricity source.

23. A substrate processing method, comprising:

providing a substrate having a process side;

providing a substrate processing apparatus coupled to at least one electricity source, the substrate processing apparatus including a processing piece adapted to facilitate mechanical and chemical interaction with the substrate, and a substrate holder adapted to hold the substrate during processing;

wherein said providing a substrate processing apparatus includes:

providing a substrate holder having two or more substrate holder portions electrically isolated from each other;

providing a processing piece having two or more processing elements corresponding to each of the substrate holder portions;

coupling the two or more substrate holder portions to a first at least one electricity source to provide different voltages to the two or more substrate holder portions;

coupling the two or more processing elements to a second at least one electricity source to provide different voltages to the two or more processing elements, each of the two or more processing elements positioned along the processing piece to correspond to a different one of the two or more substrate holder portions;

creating at least two distinct electrical potentials between each pair of corresponding processing elements and substrate holder portions in the substrate processing apparatus that affects the process side of the substrate; and selectively controlling removal of material from the process side of the substrate by controlling the at least two distinct electrical potential.

24. The method of claim 23, further comprising controlling the electrical potential independently across portions of the substrate that are positioned between each of the two or more processing elements and each corresponding two or more substrate holder portions.

25. The method of claim 24, wherein controlling the electrical potential includes selectively applying different voltages to each of the two or more processing elements and selectively applying different voltages to the two or more substrate holder portions.

26. The method of claim 23, wherein providing the substrate processing apparatus comprises:

providing a conductive first element substantially adjacent to a first side of at least one processing element and a conductive second element substantially adjacent to a second side of the at least one processing element;

coupling a first electricity source to the first element and a complementary second electricity source to the second element; and generating an electrical potential between the at least one processing element.

27. The method of claim 23, further comprising:

coupling a metrology device to the processing apparatus adapted to monitor processing of the process side of the substrate; and coupling a control unit to the metrology device and the at least one electricity source to selectively control the voltages supplied to the substrate processing apparatus.

* * * * *

UNITED STATES PATENT AND TRADEMARK OFFICE

CERTIFICATE OF CORRECTION

PATENT NO. : 7,097,536 B2
APPLICATION NO. : 10/883499
DATED : August 29, 2006
INVENTOR(S) : Reza M. Golzarian It is certified that error appears in the above-identified patent and that said Letters Patent is hereby corrected as shown below:

Figure 2B
[Ref no.] "11'" should be deleted.

Column 3
Line 7, "...processing pads 20..." should read --...polishing pads 20...--.
Lines 9-10, "...processing elements/pads 20..." should read --polishing elements/pads 20...--.

Column 6
Line 12, "...processing side 13..." should read --...process side of the substrate 13...--.
Lines 57-58, "...polishing pad 322..." should read --...polishing elements 322...--.
Line 65, "...processing pieces 320 and 320'..." should read --...processing pieces 320 and 321...--.

Column 7
Line 53, "...processing element 350..." should read --...processing element 354...--.

Column 9
Line 33, "...substrate hoolder..." should read --...substrate holder...--.

Column 11
Line 38, "...substrate hoolder..." should read --...substrate holder...--.

Signed and Sealed this

Sixteenth Day of February, 2010

David J. Kappos

David J. Kappos
*Director of the United States Patent and Trademark Office*